US011039718B2

(12) United States Patent
Ledesma

(10) Patent No.: US 11,039,718 B2
(45) Date of Patent: Jun. 22, 2021

(54) INVERTED BOTTLE HANGING APPARATUS

(71) Applicant: Jonpaul Ledesma, Austin, TX (US)

(72) Inventor: Jonpaul Ledesma, Austin, TX (US)

( * ) Notice: Subject to any disclaimer, the term of this patent is extended or adjusted under 35 U.S.C. 154(b) by 138 days.

(21) Appl. No.: 16/059,753

(22) Filed: Aug. 9, 2018

(65) Prior Publication Data

US 2020/0046174 A1 Feb. 13, 2020

(51) Int. Cl.
*A47K 5/13* (2006.01)
*B65D 23/00* (2006.01)

(52) U.S. Cl.
CPC ..... *A47K 5/13* (2013.01); *B65D 23/003* (2013.01)

(58) Field of Classification Search
CPC ..... A47K 5/13; B65D 23/003
USPC ..... 215/395, 399; 220/737, 741, 742, 743; 224/148.4, 148.5, 148.6; 248/102, 104, 248/311.2, 311.3, 312, 312.1, 318; 294/31.2
See application file for complete search history.

(56) References Cited

U.S. PATENT DOCUMENTS 784,914 A * 3/1905 Boyle ..... A47J 41/02 215/12.1
1,342,747 A 6/1920 Hyland
1,750,672 A 3/1930 Max
1,890,482 A * 12/1932 Weissberg ..... A61J 9/06 215/11.1
2,518,862 A * 8/1950 Cain ..... A61J 9/0638 248/104
2,825,521 A 3/1958 Nesset et al.
3,463,536 A * 8/1969 Beyer ..... B65D 23/108 294/31.2
3,653,610 A * 4/1972 Owen ..... A61M 5/1417 294/31.2
4,090,729 A * 5/1978 Erickson ..... B65D 23/108 215/396
4,412,624 A 11/1983 Tanaka
4,582,215 A * 4/1986 Barrash ..... B65D 23/108 206/150
4,747,519 A 5/1988 Green et al.
4,989,811 A 2/1991 Millis et al.
5,203,481 A * 4/1993 Dobbins ..... A45F 3/14 215/396
5,292,162 A * 3/1994 Korngold ..... B65D 25/32 220/758

(Continued)

*Primary Examiner* — Joshua E Rodden
(74) *Attorney, Agent, or Firm* — Scheinberg & Associates, PC; Michael O. Scheinberg

(57) ABSTRACT

An inverted bottle hanging device and method of manufacturing and using the device is disclosed. The inverted bottle hanging device comprises a cord for hanging the device around a bathroom fixture and an elastomeric base unit which includes a bottle hole adapted in size and shape to receive a bottle and maintaining the bottle in a fixed position relative to the bottle hole at least in part by way of friction between the base unit and the bottle. The elastomeric base unit includes one or more cord holes adapted in size and shape to receive the cord for hanging the device around the bathroom fixture. The method includes inserting the bottle into the bottle hole such that the elastomeric base unit deforms and causes the surface area of the elastomeric base unit in contact with the bottle to increase, increasing the frictional force holding the bottle in the fixed position.

16 Claims, 5 Drawing Sheets

(56) References Cited

U.S. PATENT DOCUMENTS

D347,734 S * 6/1994 Patterson ..... D3/229
5,413,261 A * 5/1995 Wu ..... A45F 3/14 215/396
5,435,513 A 7/1995 Davis
5,511,754 A * 4/1996 Johannsen ..... A47C 7/68 248/311.2
5,711,500 A * 1/1998 De Los Santos ..... A61J 9/0676 248/102
5,810,218 A * 9/1998 Falcaro ..... A45F 5/00 224/148.1
5,890,635 A * 4/1999 Wu ..... A45F 3/14 215/395
5,954,247 A * 9/1999 Savine ..... A45F 5/00 215/399
6,102,441 A 8/2000 Treleaven et al.
6,616,024 B1 * 9/2003 Perry ..... G10D 7/03 224/604
6,644,613 B2 11/2003 Grosskopf
7,975,887 B1 * 7/2011 Esposito ..... A45F 5/10 224/148.6
8,235,190 B2 * 8/2012 Porte ..... A45C 5/14 190/100
8,844,763 B1 * 9/2014 Momirov ..... B65D 33/28 150/154
9,611,132 B1 4/2017 Meyer
10,314,381 B1 * 6/2019 Silva ..... A45D 44/08
2003/0168564 A1 * 9/2003 Blanke ..... B66C 1/12 248/318
2005/0109803 A1 * 5/2005 Shin ..... A45F 5/021 224/148.4
2014/0166610 A1 * 6/2014 Paterson ..... B65D 23/003 215/399
2014/0305954 A1 * 10/2014 Singh ..... A47G 23/0216 220/737
2015/0265083 A1 * 9/2015 Myers ..... A45F 5/10 220/739
2019/0142195 A1 * 5/2019 Bishop ..... A47G 23/0208 215/395

* cited by examiner

INVERTED BOTTLE HANGING APPARATUS

TECHNICAL FIELD OF THE INVENTION

The technical field of the present invention relates in general to devices for hanging containers to facilitate dispensing of personal care products.

BACKGROUND OF THE INVENTION

Personal care products for use in bathing are typically in the form of viscous liquids, gels, emulsions, colloidal suspensions, and the like, including, but not limited to, shampoo, hair conditioner, body wash, facial wash, exfoliants, shaving cream, etc. Such personal care products are typically distributed and sold in bottles, tubes, cans, and other containers (collectively "bottles") that are intended to be used in the bathing environment, including showers, bath tubs, spas and hot tubs, etc.

With an increasing variety of personal care products on the market, one issue that arises is the relative lack of horizontal space in the bathing environment to place all of the bottles used by the various people who may share a particular shower or bath tub. Another issue that arises with keeping bottles in a damp environment for prolonged periods of time is that mold and mildew can grow on surfaces where bottles prevent evaporation of bathing water or prolong the time required for bathing water to evaporate. Metal cans, such as shaving cream cans, can rust and cause stains. Another issue that arises with bottles containing personal care products is that, due to gravity, the viscous contents of the bottles tend to collect at the end of the bottle (e.g., the bottom) that is often at the end opposite from the opening of the bottle (e.g., the top). As the bottle becomes depleted, the bather typically has to invert the bottle and shake it to get the viscous contents of the bottle to the end that has the opening.

What is needed is a way to organize and store bottles in a bathing environment that reduces or eliminates the need for horizontal surface area, that reduces or eliminates the buildup of mold and mildew and other stains, and that keeps viscous contents of the bottle at the end with the opening to reduce the time needed to dispense the viscous contents to a bather.

SUMMARY OF THE INVENTION

An embodiment of the present invention is directed to an inverted bottle hanging device comprising a cord for hanging the device around a bathroom fixture and an elastomeric base unit. The elastomeric base unit includes a bottle hole adapted in size and shape to receive a bottle and maintain the bottle in a fixed position relative to the bottle hole, wherein the bottle is maintained in a fixed position relative to the bottle hole at least in part by way of friction between the base unit and the bottle. The elastomeric base unit includes one or more cord holes adapted in size and shape to receive the cord for hanging the device around the bathroom fixture.

Another embodiment of the present invention is directed to a method of manufacturing an inverted bottle hanging device. The method includes forming an elastomeric base unit including a bottle hole adapted in size and shape to receive a bottle and maintain the bottle in a fixed position relative to the bottle hole, wherein the bottle is maintained in a fixed position relative to the bottle hole at least in part by way of friction between the base unit and the bottle; and one or more cord holes adapted in size and shape to receive the cord for hanging the device around the bathroom fixture.

The method includes affixing to each of the one or more cord holes a cord for hanging the device around a bathroom fixture.

Another embodiment of the present invention is directed to a method of hanging a bottle from a bathroom fixture in an inverted orientation. The method includes hanging an inverted bottle hanging device from a bathroom fixture. The inverted bottle hanging device includes a cord for hanging the device around a bathroom fixture and an elastomeric base unit. The elastomeric base unit includes a bottle hole adapted in size and shape to receive a bottle and maintain the bottle in a fixed position relative to the bottle hole, wherein the bottle is maintained in a fixed position relative to the bottle hole at least in part by way of friction between the base unit and the bottle; and one or more cord holes adapted in size and shape to receive the cord for hanging the device around the bathroom fixture. The method includes inserting the bottle into the bottle hole such that, when the bottle is inserted into the bottle hole, the elastomeric base unit deforms so that the surface area of the elastomeric base unit in contact with the bottle is increased, thereby increasing the frictional force holding the bottle in the fixed position.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which:

FIG. 4 shows an exemplary embodiment of an inverted bottle hanger hanging from a fixture with a bottle disposed in the bottle hole;

DETAILED DESCRIPTION OF PREFERRED EMBODIMENTS

Embodiments of the present invention include an inverted bottle hanger having a base unit and a means for hanging the apparatus. The means for hanging the apparatus can include a cord, string, rope, plastic fiber, or the like (collectively, "cord") suitable for hanging the apparatus, alone or in combination with a bottle of personal care product, around a shower head or other suitable hanging location in a bathing environment. The cord can include an adjuster, such as a push-button tensioner, that can be used to form a loop near the middle of the cord, as well as adjust the size of the loop.

The base unit can include one or more holes ("cord holes") to receive the cord and mechanically couple the cord to the base unit. The cord holes can each include a grommet to ruggedize the cord holes and prevent tearing. The base unit can also include a hole ("bottle hole") adapted in size and shape to hold a variety of common personal care product bottles. The base unit can be made from an elastomeric material that conforms to the shape of a bottle inserted into the bottle hole. The bottle is held in a fixed position within the base unit principally by means of friction between the stretched elastomeric material of the base unit and the surface of the bottle.

The bottle can be disposed in the base unit such that, when hanging, the bottle opening is at the lowermost end of the bottle-hanger assembly. A user can hold his or her hand under the bottle-hanger assembly and squeeze the bottle to dispense a portion of the personal care product. Gravity directs the personal care product toward the lowermost end of the bottle such that the personal care product collects near the opening of the bottle and is readily available to be dispensed.

Figure 1:
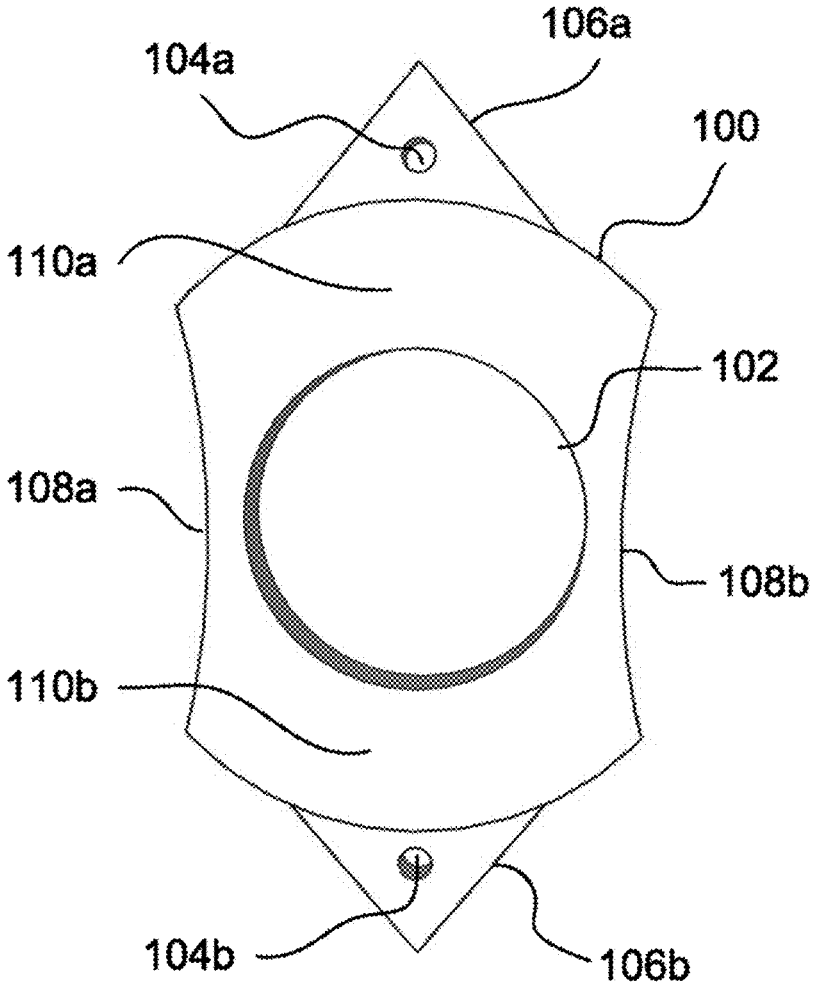
FIG. 1 shows a base unit in accordance with an exemplary embodiment of the present invention.

FIG. 1 shows a base unit in accordance with an exemplary embodiment of the present invention. Base unit 100 is preferably made from an elastomeric material (e.g., rubber, synthetic rubber, silicone, silicone rubber, flexible plastic, etc.) that is elastic with a smooth flat surface. In at least one embodiment, base unit 100 can be comprised of platinum cure silicone rubber, for example, Dragon Skin® FX-Pro by Smooth-On, Inc.

Base unit 100 includes bottle hole 102. Bottle hole 102 is adapted in size and shape to hold a variety of common personal care product bottles. In a preferred embodiment, bottle hole 102 is a 40 mm diameter hole in the center of base unit 100 that can stretch at least three times its size to conform to the shape of a personal care product bottle.

Base unit 100 can have a diamond/rectangular shape including flared ends 106*a* and 106*b*, tapered ends 108*a* and 108*b*, and gripping surfaces 110*a* and 110*b*. In combination, gripping surfaces 110*a* and 110*b* act in a manner similar to a C-clamp against the sides of the bottle, as is described in further detail below. Flared ends 106*a* and 106*b* can include cord holes 104*a* and 104*b*. Cord holes 104*a* and 104*b* are adapted in size and shape to receive a cord and mechanically couple the cord to the base unit. Tapered ends 108*a* and 108*b* enable bottle hole 102 to stretch to conform to a bottle more easily, especially for bottles having an ellipse-shaped cross-section. Tapered ends 108*a* and 108*b* also enable base unit 100 to deform in such a way that gripping surfaces 110*a* and 110*b* contact the surface of the bottle so that a greater portion of the surface area of base unit 100 is in contact with the bottle. Having a greater portion of the surface area of base unit 100 in contact with the bottle increases the frictional forces between base unit 100 and the bottle, thereby enabling a bottle of heavier weight to be hung. For example, in at least one embodiment a full bottle of 750 mL of personal care product can be hung.

Figure 2:
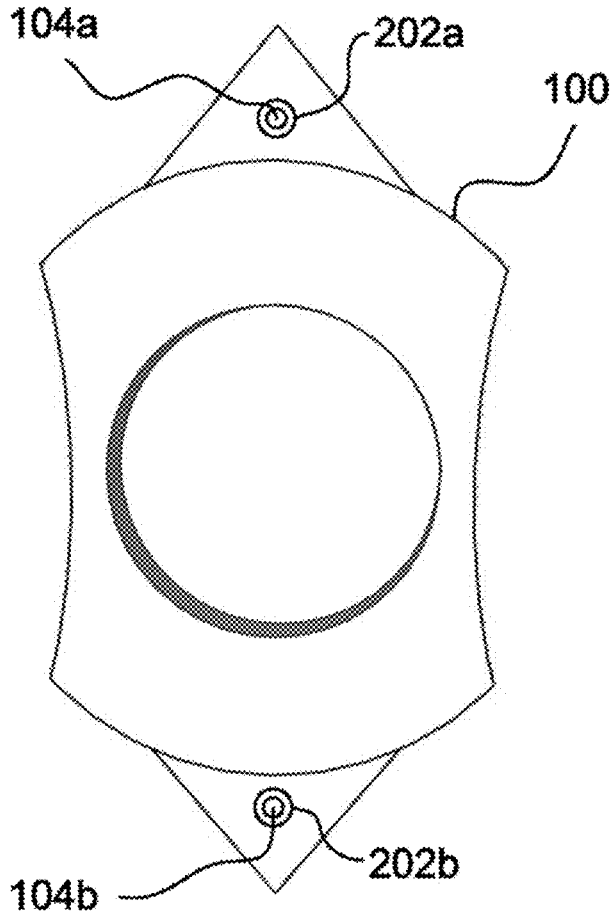
FIG. 2 shows an embodiment of the base unit with grommets for receiving a cord used for hanging the apparatus.

FIG. 2 shows an embodiment of the base unit with grommets for receiving a cord used for hanging the apparatus. Base unit 100 includes cord holes 104*a* and 104*b*. Cord holes 104*a* and 104*b* include grommets 202*a* and 202*b* to ruggedize the cord holes and prevent tearing. Grommets 202*a* and 202*b* can be made of any material suitable for reinforcing cord holes 104*a* and 104*b* based on the elastomeric material comprising base unit 100. For example, grommets 202*a* and 202*b* can be made of rubber, synthetic rubber, silicone, silicone rubber, flexible plastic.

Figure 3:
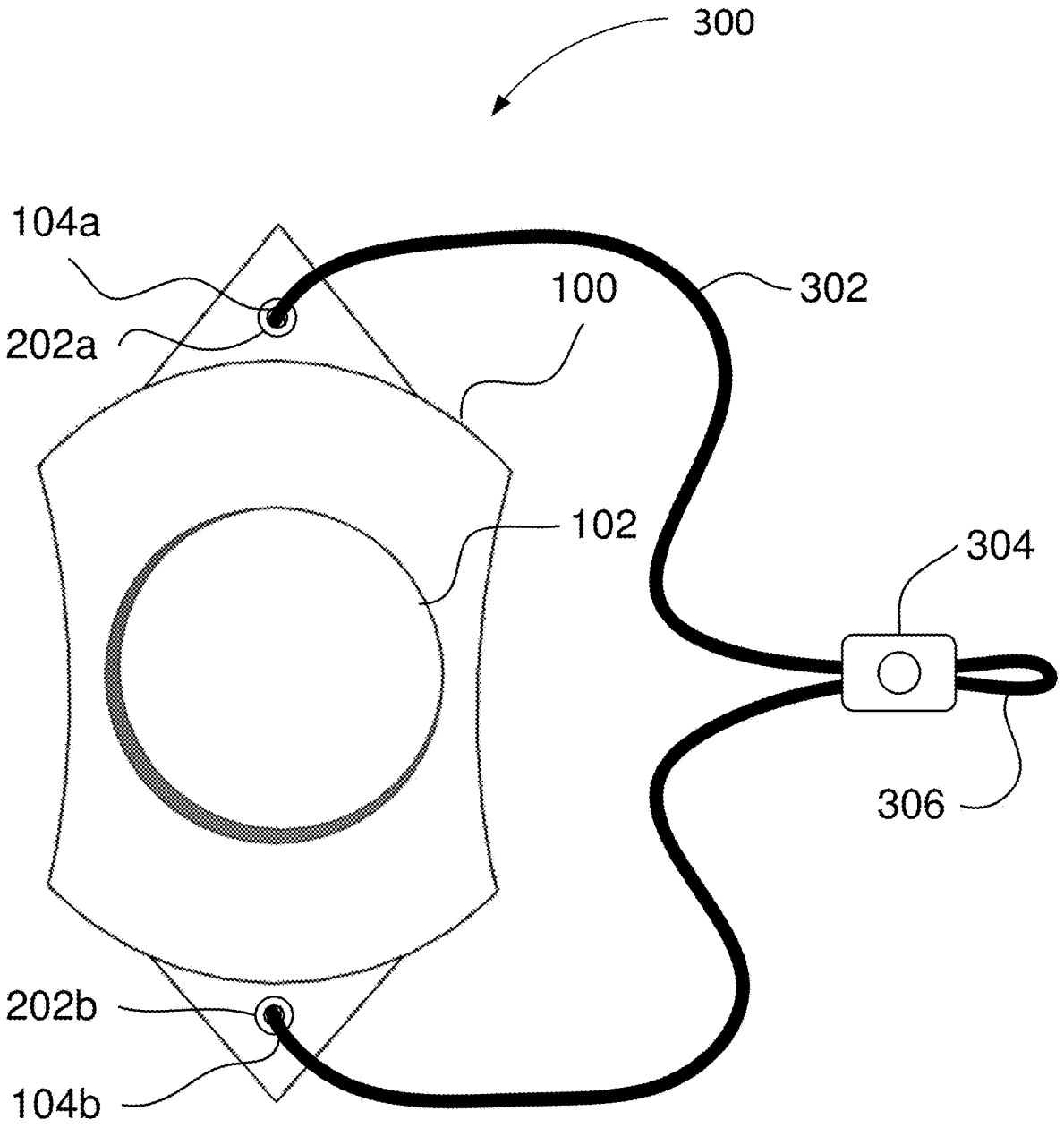
FIG. 3 shows an exemplary embodiment of an inverted bottle hanger.

FIG. 3 shows an exemplary embodiment of an inverted bottle hanger. Inverted bottle hanger 300 includes base unit 100, cord 302, and an adjuster 304. Inverted bottle hanger 300 can also include grommets 202*a* and 202*b*. Cord 302 can comprise a two-millimeter diameter string, preferably a string that is suitable for a wet environment (e.g. nylon). Cord 302 can comprise silicone fused as one unit with base unit 100. Each end of cord 302 is fed through grommets 202*a* and 202*b*. The ends of cord 302 can be looped back on themselves and crimped to form a loop at each end that is fixed to based unit 100 through cord holes 104*a* and 104*b* and grommets 202*a* and 202*b*. Cord 302 is of sufficient length such that a bottle is at the proper height for a bather when the bottle is disposed in the bottle hanger and hung from a shower head. Cord 302 can include adjuster 304 for forming loop 306 near the middle of cord 302, as well as adjust the size of loop 306. Loop 306 can be used to hang inverted bottle holder 300 in the bathing environment, such as over a shower head, a water valve knob, a spigot, or on a hook mounted on a wall.

Figure 4:
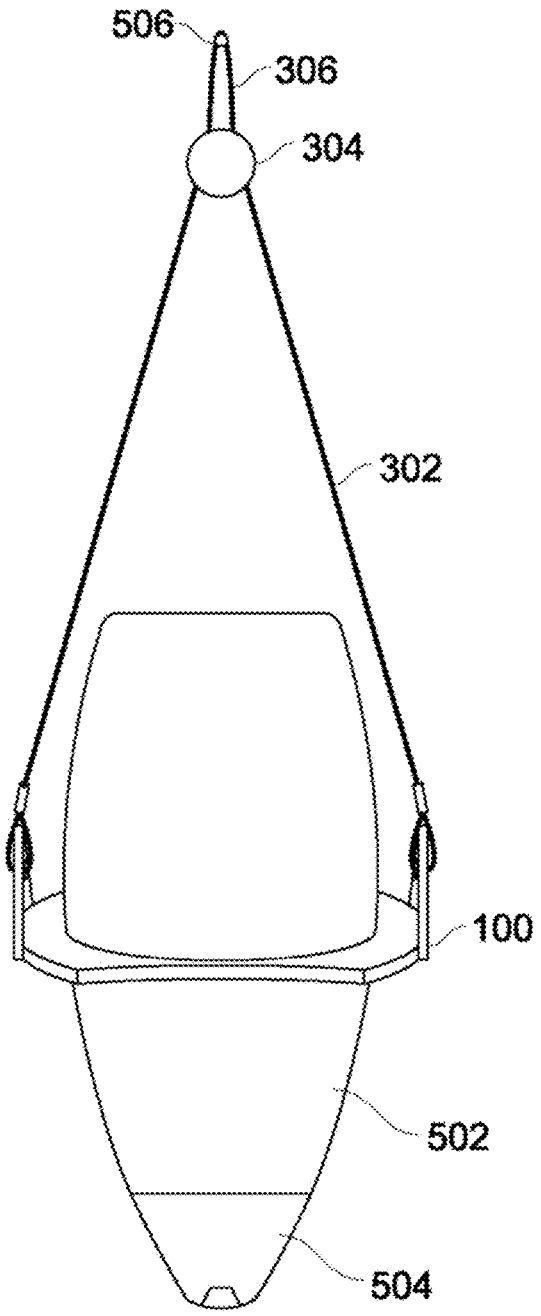
FIG. 4 shows another exemplary embodiment of an inverted bottle hanger.
Figure 5:
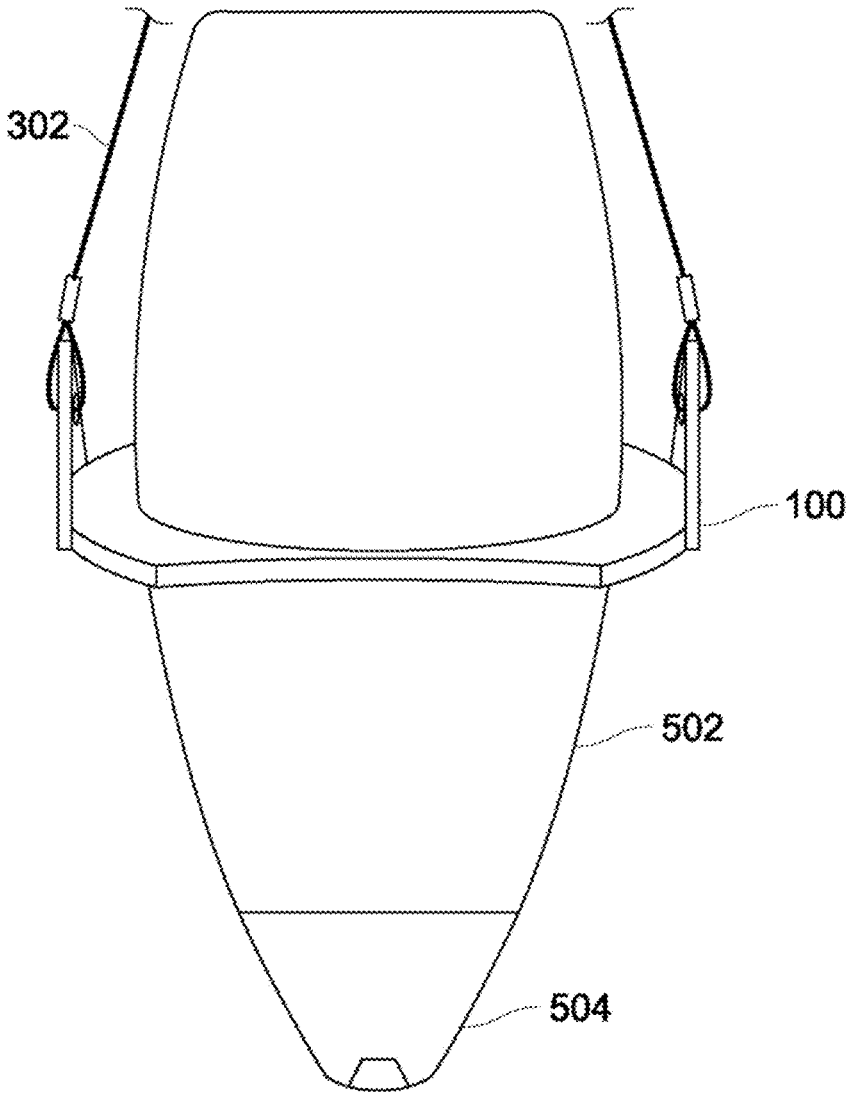
FIG. 5 shows another exemplary embodiment of an inverted bottle hanger hanging from a fixture with a bottle disposed in the bottle hole.

FIGS. 4 and 5 show an exemplary embodiment of an inverted bottle hanger hanging from a fixture with a bottle disposed in the bottle hole. Loop 306 is disposed around fixture 506 so that the inverted bottle holder is suspended by cord 302. Bottle 502 is inserted into bottle hole 102 of base unit 100. Bottle 502 is preferably inserted such that bottle opening 504 is at the lowest point (i.e. the bottle is inverted or upside-down). Hanging the bottle opening 504 at the lowest point enables viscous personal care products to collect near bottle opening 504 to facilitate the dispensing of the personal care product. Base unit 100 stretches and conforms to the shape of bottle 502. The tension in the stretched elastomeric material comprising base unit 100 causes the base unit 100 to grip bottle 502 and hold it in place. Further gripping surfaces 110*a* and 110*b* rotate downward so that all or a greater portion of gripping surfaces 110*a* and 110*b* are in contact with the outer surface of bottle 502. This increases the surface area of base unit 100 that is in contact with bottle 502, and increases the frictional forces holding bottle 502 in a fixed position within bottle hole 102. Further, because the weight of bottle 502 is being supported by cord 302, cord 302 draws flared ends 106*a* and 106*b* in toward the center of gravity, thereby causing base gripping surfaces 110*a* and 110*b* to also be drawn in and press tighter against bottle 502. This causes gripping surfaces 110*a* and 110*b* to act in a manner similar to a C-clamp against the sides of bottle 502, which enables the inverted bottle hanger 300 to hold substantial weight, such as a full 750 mL bottle of personal care product.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

I claim:

1. A method of manufacturing an inverted bottle hanging device, the method comprising:

forming an elastomeric base unit including:

a bottle hole adapted in size and shape to receive a bottle and maintain the bottle in a fixed position relative to the bottle hole, wherein the bottle is maintained in the fixed position relative to the bottle hole at least in part by way of friction between the base unit and the bottle;

one or more flat gripping portions;

for each of the one or more flat gripping portions one or more cord holes adapted in size and shape to receive a cord for hanging the device around the bathroom fixture so that when an inverted bottle is inserted into the bottle hole and the cord hung around a bathroom fixture at least one of the one or more flat gripping portions bends and a part of a surface of the at least one flat gripping portion is pressed against a surface of the bottles, the flat gripping portions having first portions having a first thickness and second portions of the elastomeric base unit surrounding the cord holes have a second thickness, the second thickness smaller than the first thickness; and affixing to each of the one or more cord holes a cord for hanging the device around a bathroom fixture.

2. The method of claim 1 in which the elastomeric base unit is formed such that, when the bottle is inserted into the bottle hole, the elastomeric base unit deforms so that the contact of the elastomeric base unit with the bottle is increased.

3. The method of claim 1 further comprising selecting a material comprising the elastomeric base unit from a group consisting of: rubber, synthetic rubber, silicone, silicone rubber, and flexible plastic.

4. The method of claim 1 in which the elastomeric base unit is formed from platinum cure silicone rubber.

5. The method of claim 1 further comprising disposing a grommet within each of the one or more cord holes for receiving the cord for hanging the device around the bathroom fixture.

6. The method of claim 1 in which the bathroom fixture is a shower head.

7. An inverted bottle hanging device comprising:

a cord for hanging the device around a bathroom fixture; and an elastomeric base unit including:

a bottle hole adapted in size and shape to receive a bottle and maintain the bottle in a fixed position relative to the bottle hole at least in part by way of friction between the base unit and the bottle;

two flat gripping portions;

each of the two flat gripping portions including a cord hole adapted in size and shape to receive the cord for hanging the device around the bathroom fixture so that when an inverted bottle is inserted into the bottle hole and the cord hung around a bathroom fixture the two flat gripping portions bend upward and a part of a surface of at least one of the two flat gripping portions is pressed against the bottle;

a longitudinal axis passing through centers of the two cord holes and a center of the bottle hole and a transverse axis passing through the center of the bottle hole and perpendicular to the longitudinal axis; and two opposing arcuate edges on opposite sides of the bottle hole, the opposing arcuate edges curved such that a width of the elastomeric base defined by a distance between the opposing arcuate edges measured along a line parallel to the transverse axis is smallest at the transverse axis and the width increases as the width is measured further away from the transverse axis, the shape of the elastomeric base causing it to bend near the transverse axis when an inverted bottle is placed in the bottle hole and the elastomeric base is suspended by the cord through the cord holes.

8. The device of claim 7 in which the elastomeric base unit is adapted to deform such that, when the bottle is inserted into the bottle hole, the part of the surface of the at least one of the two flat gripping portions pressed against the bottle is increased.

9. The device of claim 7 in which the elastomeric base unit comprises a material selected from a group consisting of: rubber, synthetic rubber, silicone, silicone rubber, and flexible plastic.

10. The device of claim 7 in which the elastomeric base unit comprises platinum cure silicone rubber.

11. The device of claim 7 in which a grommet is disposed within each of the one or more cord holes for receiving the cord for hanging the device around the bathroom fixture.

12. An inverted bottle hanging device comprising:

a cord for hanging the device around a bathroom fixture; and an elastomeric base unit including:

a bottle hole adapted in size and shape to receive a bottle and maintain the bottle in a fixed position relative to the bottle hole, wherein the bottle is maintained in the fixed position relative to the bottle hole at least in part by way of friction between the base unit and the bottle;

one or more flat gripping portions; and for each of the one or more flat gripping portions, one or more cord holes adapted in size and shape to receive the cord for hanging the device around the bathroom fixture so that when an inverted bottle is inserted into the bottle hole and the cord hung around a bathroom fixture at least one of the one or more flat gripping portions bends upward and a part of a surface of the at least one flat gripping portion is pressed against the bottle; and a first region having a first thickness, the first region surrounding the bottle hole, and a second and third region, each of the second and third regions including one of the two cord holes and the second and third regions being thinner than the first thickness.

13. An inverted bottle hanging device comprising:

an elastomeric base including:

a bottle hole;

two cord holes on opposite sides of the bottle hole;

a flat region between each of the cord holes and the bottle hole where each of the flat regions have a first thickness and portions of the elastomeric base surrounding the cord holes have a second thickness, the second thickness smaller than the first thickness;

a longitudinal axis passing through centers of the two cord holes and a center of the bottle hole;

a transverse axis passing through the center of the bottle hole and perpendicular to the longitudinal axis such that a width of the elastomeric base is smallest along the transverse axis such that when an inverted bottle is inserted into the bottle hole and the elastomeric base is supported by a cord through the cord holes, the elastomeric base bends so that each of the flat regions contacts a side of the inverted bottle, thereby maintaining the bottle in an inverted position.

14. The inverted bottle hanging device of claim 13 in which the elastomeric base comprises two tapered ends.

15. The inverted bottle hanging device of claim 13 in which the elastomeric base comprises two flared ends.

16. The inverted bottle device of claim 13 further comprising a cord extending through the cord holes.

* * * * *